United States Patent [19]

Blume et al.

[11] Patent Number: 4,552,832

[45] Date of Patent: Nov. 12, 1985

[54] SHEAR FOIL HAVING PROTRUSIONS ON ITS SKIN-CONTACTING SURFACE THEREOF

[75] Inventors: Friedrich Blume, Schwalbach; Lutz Voigtmann, Ober-Mörlen, both of Fed. Rep. of Germany

[73] Assignee: Braun Aktiengesellschaft, Kronberg, Fed. Rep. of Germany

[21] Appl. No.: 470,909

[22] Filed: Mar. 1, 1983

[30] Foreign Application Priority Data

Mar. 6, 1982 [DE] Fed. Rep. of Germany ..... 3208081

[51] Int. Cl.[4] ..... G03C 5/00; B26B 19/04

[52] U.S. Cl. ..... 430/320; 430/323; 430/324; 30/346.51; 30/346.52; 30/346.61; 204/11; 204/14.1; 204/18.1; 204/24; 204/32.1

[58] Field of Search ..... 430/314, 315, 319, 320, 430/323, 324, 331; 30/346.51, 346.52, 346.61, 34.2, 43, 43.6, 43.9, 43.92; 204/11, 14.1, 24, 32.1, 18.1

[56] References Cited

U.S. PATENT DOCUMENTS

| | | | |
|---|---|---|---|
| 1,862,231 | 6/1932 | McFarland | 430/323 |
| 2,166,366 | 7/1939 | Norris | 204/6 |
| 3,382,159 | 5/1968 | Reed | 204/29 |
| 3,643,331 | 2/1972 | Futterer et al. | 30/346.54 |
| 3,655,528 | 4/1972 | Futterer | 204/11 |
| 3,695,927 | 10/1972 | Futterer | 428/601 |
| 3,726,770 | 4/1973 | Futterer | 204/16 |
| 4,139,940 | 2/1979 | Buras, Jr. et al. | 30/43.92 |
| 4,192,719 | 3/1980 | Wich | 204/11 |

FOREIGN PATENT DOCUMENTS

| | | |
|---|---|---|
| 3003379 | 1/1980 | Fed. Rep. of Germany . |
| 2010907 | 10/1978 | United Kingdom . |

*Primary Examiner*—John E. Kittle
*Assistant Examiner*—José G. Dees
*Attorney, Agent, or Firm*—Raymond J. De Vellis

[57] ABSTRACT

A method for producing a shear element having protrusions on the skin contacting surface thereof, including the steps of coating an electrically conductive surface with a photoresist, exposing the photoresist to a hold pattern and developing the photoresist to produce a grid pattern wherein the electrically conducting surface is exposed, the grid pattern defining hole areas wherein the electrically conductive surface is covered by islands of photoresist of a predetermined thickness, introducing irregularities into the surface elevation of the exposed grid, the surface irregularities being of lesser dimension of the thickness of the photoresist islands, depositing an intermediate foil onto the exposed grid overlying the introduced surface irregularities, the intermediate foil being of sufficient thickness to extend above the photoresist islands when deposited, depositing a shear foil overlying the intermediate foil, and removing the shear foil from the intermediate foil, thus producing a shear foil having protrusions on the skin contacting surface thereof but having relatively smooth surface in the regions surrounding shear openings corresponding to the locations of the photoresist islands.

9 Claims, 13 Drawing Figures

FIG. 1
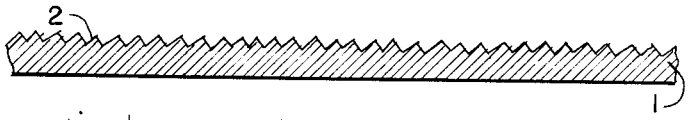
FIG. 2
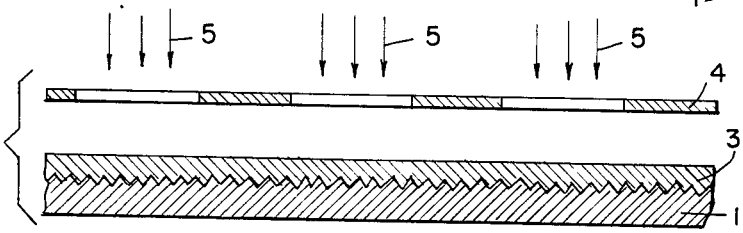
FIG. 3
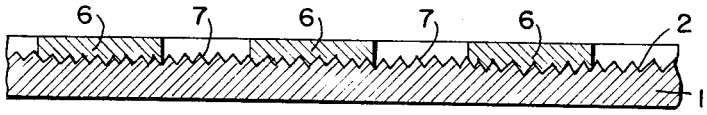
FIG. 4
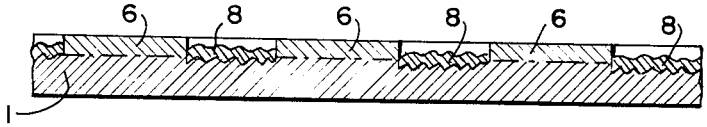
FIG. 5
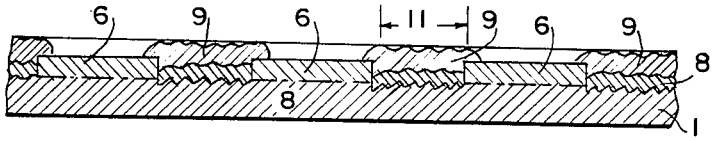
FIG. 6
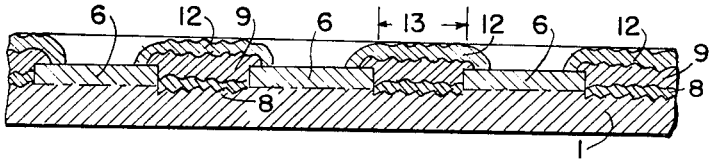
FIG. 7
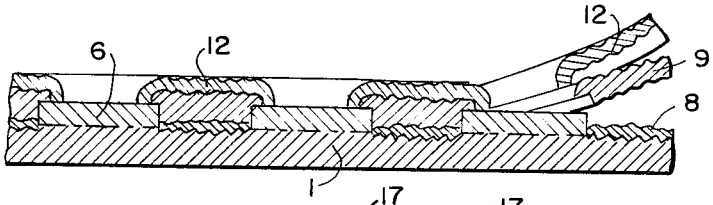
FIG. 8
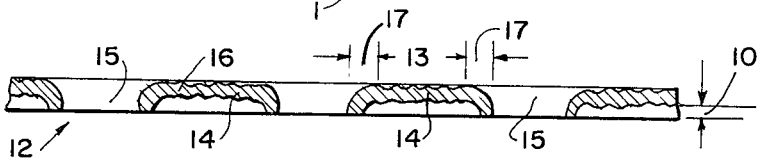
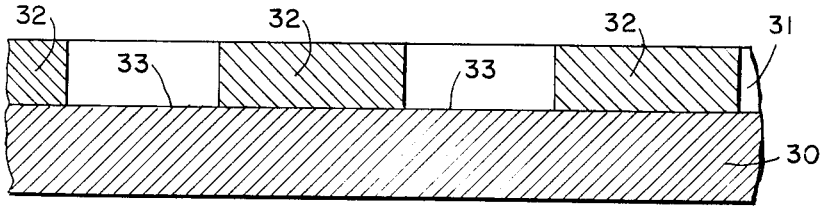
FIG. 9

PRIOR ART

SHEAR FOIL HAVING PROTRUSIONS ON ITS SKIN-CONTACTING SURFACE THEREOF

BACKGROUND OF THE INVENTION

1. Field of the Invention

The invention concerns a method for fabricating a screen-like shear foil for an electrically operated dry shaving apparatus with elevations on its surface that is turned towards the skin.

Such shear foils have the advantage that they slide on the skin easily even if the skin is greasy or moist. This is not only perceived as pleasant while shaving, but the quality of the shave is considerably improved thereby.

2. Description of the Prior Art

The DE-AS No. 30 03 379 discloses a method for fabricating a shear foil with elevations for an electrically operated dry shaving apparatus. Here, a metal plate (50) is covered with the pattern (51) of the hole area, and subsequently an intermediate metal foil (53) is built up by electroplating at the points (52) which correspond to the grid of the screen. The thickness (54) of these points is larger, corresponding to the elevations of the hole edges, than the thickness (55) of the covering (51) of the hole area. Finely distributed solid particles (56) are applied to the surface of the intermediate metal foil (53). Only after this is the shear foil (57) deposited by electroplating in well-known fashion, and is removed from the intermediate metal foil (53) by being torn off (FIG. 13).

The known method has the disadvantage that elevations are formed not only on that surface of the shear foil which is turned towards the skin but also in the region of the hole edge. This can result in undercuts, which, on the one hand, make it much more difficult to tear off the shear foil and, on the other hand, frequently yield a negative cutting angle at the cutting edges of the hole-edge elevations. This has an unfavorable effect on the cutting behavior.

SUMMARY OF THE INVENTION

The invention has the aim of making available a method for producing a screen-like shear foil for an electrically operated dry shaving apparatus with elevations on that surface which is turned towards the skin. This will eliminate the above-mentioned disadvantages by preventing undercuts and negative cutting angles at the cutting points of the hole-edge elevations. Thus, a still more economical and precise production of shear foils in large numbers of units and with improved cutting behavior is made possible.

The invention achieves its aim by a method for producing a screen-like shear foil (12, 39) for an electrically operated dry shaving apparatus with elevations (16, 40) on that surface which is turned towards the skin, as follows: An electrically conducting plate (1, 30) is covered (6, 32) with the pattern of the hole field, and subsequently an intermediate metal foil (9, 36) is built up, by electroplating, at the points which correspond to the grid of the screen, whose thickness is larger, in correspondence with the hole-edge elevations (10, 43), than the thickness of the cover of the hole area (6, 32). The shear foil (12, 39) is electrolytically deposited on the intermediate metal foil (9, 36). It is removed from the intermediate metal foil (9, 36) by tearing off. Here, according to the invention, the electrically conducting plate (1, 30) has elevations (2, 40) with a lesser height than the thickness of the covering of the hole area (6, 32).

The electrically conducting plate can be a metal plate; but it can also be a plate of an electrically nonconducting material whose surface is designed so as to be electrically conducting.

Even before the covering, the plate can be provided with the pattern of the hole field with the elevations, for example by sandblasting, etching, or noncutting deformation. But it is also possible first to cover it with the pattern of the hole field and then to provide the elevations, for example by the electrolytic deposition of metal together with solid materials from a dispersion at the current-conducting points of the plate.

The above-mentioned process steps can be performed in a manner that is in itself well known, with formulations that are in themselves well known.

The intermediate metal foil is deposited in a manner that is in itself well known; it has elevations only in the area of the maximum growth of the elevations at the plate and not in the region of the hole edges; thus, the formation of undercuts is prevented at the shear foil which now has been deposited in a manner that is in itself well known. Also, no negative cutting angles form at the cutting points of the hole-edge elevations. The elevations are situated at the desired points.

The invention will be explained below in more detail in terms of two embodiments, whose individual process steps are shown in the drawing. The following are shown:

BRIEF DESCRIPTION OF THE DRAWINGS

FIGS. 1 through 7 show a cross section through a cutout of the matrix during the individual process steps with a first embodiment.

FIG. 8 shows a cross section through a cutout of the shear foil as end product.

FIGS. 9 through 12 show a cross section through a cutout of the matrix during the essential process steps with a second embodiment.

DESCRIPTION OF THE PREFERRED EMBODIMENTS

EXAMPLE 1

Figure 10:
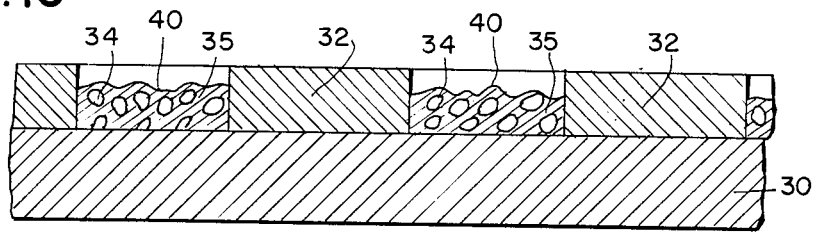

The electrically conducting brass plate 1, which is shown in FIG. 1, is brought to a roughness of maximally 15 μm by sandblasting, in order to form the elevations 2 (FIG. 1). Subsequently, a layer of photo-sensitive resist, 25 μm thick, is applied to the brass plate 1. It is exposed through a template 4 in accord with the shear foil geometry, as indicated by the arrows 5 (FIG. 2). The exposed points are subsequently developed in the usual manner, are hardened, burned in, and the non-exposed points are removed from the brass plate 1, so that a hole-field covering 6 remains which corresponds to the pattern of the hole field of the shear foil (FIG. 3). In the following figures, the roughness of the brass plate 1 below the hole-field covering 6 is indicated by dots and dashes. A solidly adhering layer 8 maximally 10 μm thick, is now built up in a nickel bath, on the conducting surfaces 7 between the hole-field covering 6. At its surface, this layer 8 reproduces a conformal image of the elevations 2 of the brass plate 1; the thickness of the nickel layer 8 is less than the thickness of the hole-field covering 6 (FIG. 4). The surface of the nickel layer 8 is passivated. In a non-leveling nickel bath, an intermediate metal foil 9 is built up high enough so that it extends beyond the hole-field covering 6 through the heightwise and sidewise growth of the nickel crystals; the thickness of this intermediate metal foil 9 corresponds to the desired hole-edge elevation 10 of the shear foil. This will be discussed in more detail later, in conjunction with FIG. 8. The surface of the intermediate metal foil 9, in the region 11 between the hole-field coverings 6, contains the conformal image of the roughness of the brass plate 1 at the surfaces 7 (FIG. 5). After the surface of the intermediate metal foil 9 has been passivated, the shear foil 12 is electrolytically desposited in a slightly leveling nickel bath. The region 13 of its surface corresponds to the above-mentioned region 11. Here again, the roughness of the brass plate 1 is imaged (FIG. 6). The shear foil 12 is first of all pulled from the brass plate 1 jointly with the intermediate metal foil 9 - the layer 8 continues to adhere to it - and the shear foil 12 is obtained as the end product of the intermediate metal foil 9 by being separated from it (FIG. 7). FIG. 8 shows the separated shear foil 12 with its ridges 14, the holes 15, and the hole-edge elevation 10, which surrounds each hole 15 like a collar; it can be seen that the elevations 16 are present only in the middle region 13 of the ridges 14, where these regions are turned towards the skin of the user when the shear foil is being used. No elevations 16 are present in the region 17 of the hole-edge elevation.

EXAMPLE 2

Figure 11:
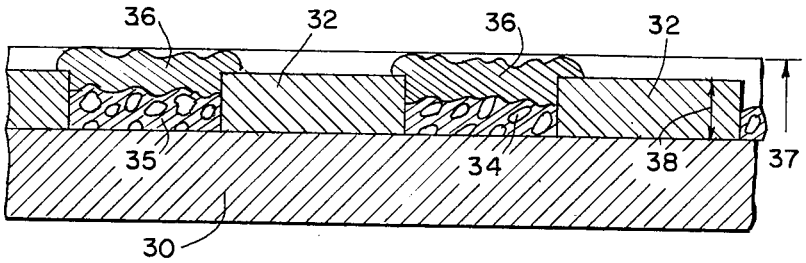
Figure 12:
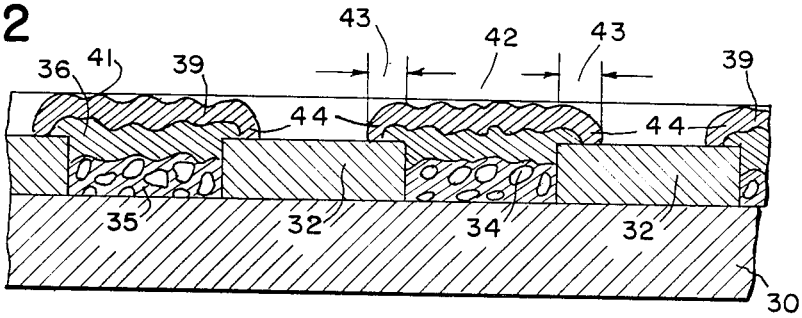

The electrically conducting brass plate 30, shown in FIG. 9, is coated with a photopolymer film 31, 25μ thick. It is exposed in accord with the shear foil geometry, is developed, and is treated in the same fashion as was explained above in conjunction with FIGS. 2 and 3. Thus, a hole-field cover 32 remains on the plate 30. This hole-field cover is associated with the subsequent shear foil holes. At the exposed points 33 of the plate 30, which are associated with the ridges of the shear foil, a layer 35 consisting of nickel and silicon carbide, 15 μm thick, is applied so as to adhere solidly, and is passivated. This layer is applied from a nickel bath which contains silicon carbide 34 in a grain size from 5 to 10 μm. The thickness of this nickel layer 35 is less than the thickness of the hole-field covering 32 (FIG. 10). Subsequently, an intermediate metal foil 36 is electroplated from a nickel bath, and specifically with a height 37 which extends beyond the thickness 38 of the hole-field covering 32, as can be seen from FIG. 11. After passivation, the shear foil 39 is deposited out at the intermediate metal foil 36, from a slightly leveling nickel bath. Here too, the shear foil 39 is first pulled from the brass plate 30 together with the intermediate metal foil 36. Here, the layer 35 remains thereon, and the shear foil 39 is obtained as the end product by separation from the intermediate metal foil 36. The elevations 40, which are caused by the silicon carbide grains 34, continue conformally through the intermediate metal foil 36. They are imaged on the surface of the ridges of the shear foil 39 as similar elevations 41, but, here too, only in the region 42 which is turned towards the skin. There are no elevations 41 in the region 43 of the hole-edge elevations 44. The finished shear foil has the same form as shown in FIG. 8.

Figure 13:
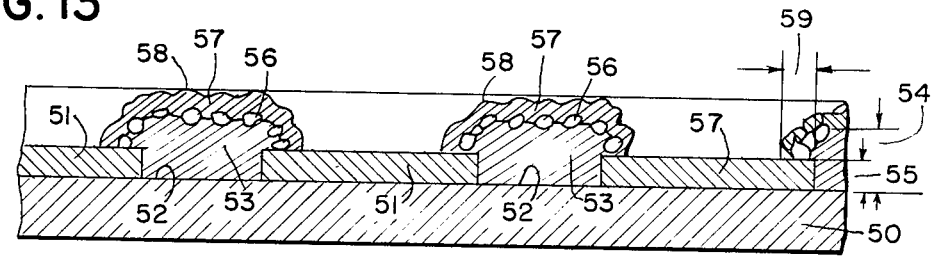
FIG. 13 shows a cross section through a cutout of the matrix of a process according to the prior art.

FIG. 13 shows a method to fabricate a shear foil with elevations, which is known from the DE-AS No. 30 03 379. With this method, a metal plate 50 is covered with the pattern of the hole field, in the manner described above. The exposed, electrically conducting regions 52 correspond to the grid of the perforated shear foil. In these regions 52, an intermediate metal foil 53 is built up electrolytically. Its thickness dimension 54 is greater than the thickness dimension 55 of the hole-field covering 51, so that the intermediate foil 53 overlaps the hole-field covering 51 because of the heightwise and sidewise growth of the nickel crystals during the electrolytic build-up process. Finely distributed solid particles 56 are applied at the surface of the intermediate metal foil 53. Only then is the final shear foil 57 electrolytically deposited on the intermediate metal foil 53. After the electrolytic deposition process has been completed, the shear foil 57 is separated by being torn off from the intermediate metal foil 53. The solid particles 56 have been imaged conformally on the shear foil 57, as elevations 58 which extend over the entire surface up to the region 59 of the hole-edge elevation.

We claim:

1. A method for producing a shear element having protrusions on the skin-contacting surface thereof, comprising the steps of:

coating an electrically conductive surface with a photoresist;

exposing said photoresist to a hole pattern and developing said photoresist to produce a grid pattern wherein said electrically conductive surface is exposed, said grid pattern defining hole areas wherein said electrically conductive surface is covered by islands of photoresist of a predetermined thickness;

introducing irregularities into the surface elevation of said exposed grid, said surface irregularities being of lesser dimension than the thickness of said photoresist islands;

depositing an intermediate foil onto said exposed grid overlying said introduced surface irregularities, said intermediate foil being of sufficient thickness to extend above said photoresist islands when deposited;

depositing a shear foil overlying said intermediate foil; and removing said shear foil from said intermediate foil;

whereby there is produced a shear foil having protrusions on the skin-contacting surface thereof but having relatively smooth surfaces in the regions surrounding shear openings which are disposed on said shear foil in correspondence with the positioning of said photoresist islands.

2. A process as in claim 1, wherein said surface irregularities are introduced by abrading said electrically conductive surface.

3. A process as in claim 1, wherein said surface irregularities are introduced by depositing onto said electrically conductive surface a base layer containing granular material prior to the deposition of said intermediate foil thereover.

4. A process as in claim 3, wherein said granular material is silicone carbide in a grain size ranging from 5 to 10 micrometers.

5. A process as in claim 4, wherein the thickness of said base layer is less than the thickness of said photoresist islands.

6. A process according to claim 2, further comprising the step of depositing a base layer over said abraded electrically conductive surface prior to the deposition of said intermediate foil over said base layer.

7. A process according to claim 6, wherein the thickness of said base layer is less than the thickness of said photoresist islands.

8. A process according to claim 5, wherein both said base layer and said intermediate foil are passivated following deposition thereof.

9. A process as in claim 7, wherein both said base layer and said intermediate foil are passivated following deposition thereof.

* * * * *